US008109067B2

(12) United States Patent
Chatte

(10) Patent No.: US 8,109,067 B2
(45) Date of Patent: Feb. 7, 2012

(54) SYSTEM FOR MANAGING DOCUMENTS WITHOUT PRINTED MARK RECOGNITION

(75) Inventor: Fabien Chatte, Nogent sur Marne (FR)

(73) Assignee: Neopost Technologies, Bagneux (FR)

( * ) Notice: Subject to any disclaimer, the term of this patent is extended or adjusted under 35 U.S.C. 154(b) by 51 days.

(21) Appl. No.: 12/327,121

(22) Filed: Dec. 3, 2008

(65) Prior Publication Data

US 2009/0145082 A1 Jun. 11, 2009

(30) Foreign Application Priority Data

Dec. 7, 2007 (FR) ..... 07 59636

(51) Int. Cl.
*B43M 3/04* (2006.01)

(52) U.S. Cl. ..... 53/475; 53/473; 53/284.3

(58) Field of Classification Search ..... 53/460, 53/569, 235, 247; 700/227, 284.3, 473, 475
See application file for complete search history.

(56) References Cited

U.S. PATENT DOCUMENTS

| | | | | |
|---|---|---|---|---|
| 6,026,385 | A * | 2/2000 | Harvey et al. | 705/408 |
| 6,386,543 | B1 * | 5/2002 | Luker | 273/272 |
| 6,888,084 | B1 * | 5/2005 | Bayer | 209/584 |
| 2005/0171919 | A1 * | 8/2005 | Baker et al. | 705/404 |
| 2006/0284360 | A1 * | 12/2006 | Hume et al. | 270/1.02 |
| 2007/0252009 | A1 * | 11/2007 | Kingsborough et al. | 235/487 |
| 2008/0162381 | A1 * | 7/2008 | Runstrom et al. | 705/402 |

FOREIGN PATENT DOCUMENTS

| | | | |
|---|---|---|---|
| FR | 2896902 | A1 | 8/2007 |
| WO | 2004/089646 | A1 | 10/2004 |

* cited by examiner

*Primary Examiner* — Christopher Harmon
(74) *Attorney, Agent, or Firm* — Sughrue Mion, PLLC

(57) ABSTRACT

In a mail production system comprising at least one user workstation on which a document is generated, printer means for printing the pages of said document, and folding and insertion means for folding the pages once they have been printed and for inserting them into an envelope, a method is provided in which, in order to control insertion into the envelope of each of the pages of the document, a unique marking code is generated, for each page of said document, on the basis of a predetermined combination of characters on each of said pages.

5 Claims, 3 Drawing Sheets

SYSTEM FOR MANAGING DOCUMENTS WITHOUT PRINTED MARK RECOGNITION

TECHNICAL FIELD

The present invention relates to the general technical field of electronic production of mail, and it relates more particularly to a method of marking the pages of a document that makes it possible to control document folding and insertion means without having recourse, in conventional manner, to Optical Mark Recognition (OMR).

STATE OF THE ART

Electronic production of mail is a high-growth field because nowadays there is an increasing tendency to replace paper documents with electronic documents. It is, in particular, implemented in mail handling system as illustrated by the Applicant's Application FR 2 896 902.

In such mail handling systems, it is important, during the document insertion stage, for the system to have information about the various documents to be inserted into any given envelope in order to check that none of them are missing (integrity checking). Currently that information is obtained by means of marks printed on the documents to be inserted, such marks being suitable for OMR. Unfortunately, since such marks are often in the form of black lines on an edge of each page, they are particularly unsightly and ill-suited for sending commercial mail whose presentation must be particularly attractive.

Therefore, thought has been given to omitting such marks and to replacing them with data stored in a Radiofrequency Identification (RFID) chip or tag integrated into each of the pages of the document. Unfortunately, such a solution is very costly, and, in addition, it requires specific reader devices.

OBJECT AND SUMMARY OF THE INVENTION

The present invention thus proposes a solution that makes it possible, at a reasonable cost, to omit such marks on printed documents that are subsequently to be inserted into envelopes.

This object is achieved by a method of inserting pages of a document into an envelope in a mail production system comprising at least one user workstation on which said document is generated, printer means for printing the pages of said document, and folding and insertion means for folding the pages once they have been printed and for inserting them into an envelope, in which method in order to control insertion into said envelope of each of said pages of the document, said folding and insertion means generate, for each page of said document, a unique marking code on the basis of a predetermined combination of characters extracted from each of said pages, then said unique marking codes obtained in this way are compared with marking codes that are generated while said documents are being generated and on the basis of said predetermined combination of characters, and that are stored in a database accessible from said folding and insertion means.

Thus, physically placing a mark by printing it on each page is no longer necessary in order to perform the folding and insertion operations in a mail production system.

Advantageously, said predetermined combination of characters is an alphanumeric word formed by a string of the $n^{th}$ characters of at the most each of the lines of said page, where n is predetermined, not less than one and less than or equal to the number of characters per line of said page. The alphanumeric word can also be formed by a string of the $n^{th}$ and $k^{th}$ characters of each of the lines of said page, where n and k are predetermined and each of them is less than or equal to the number of characters per line of said page, n being not less than 1 and k being not less than 2. The alphanumeric word can also be formed by a string comprising the first character of the first line, the second character of the second line, the third character of the third line and so on to the last line of the page.

Preferably, said unique marking code is generated at a computer server and is then sent to said folding and insertion means with control information for controlling said folding and insertion means.

BRIEF DESCRIPTION OF THE DRAWINGS

Other characteristics and advantages of the present invention appear more clearly from the following description given by way of non-limiting indication and with reference to the accompanying drawings, in which.

IMPLEMENTATION(S) OF THE INVENTION

Figure 1:
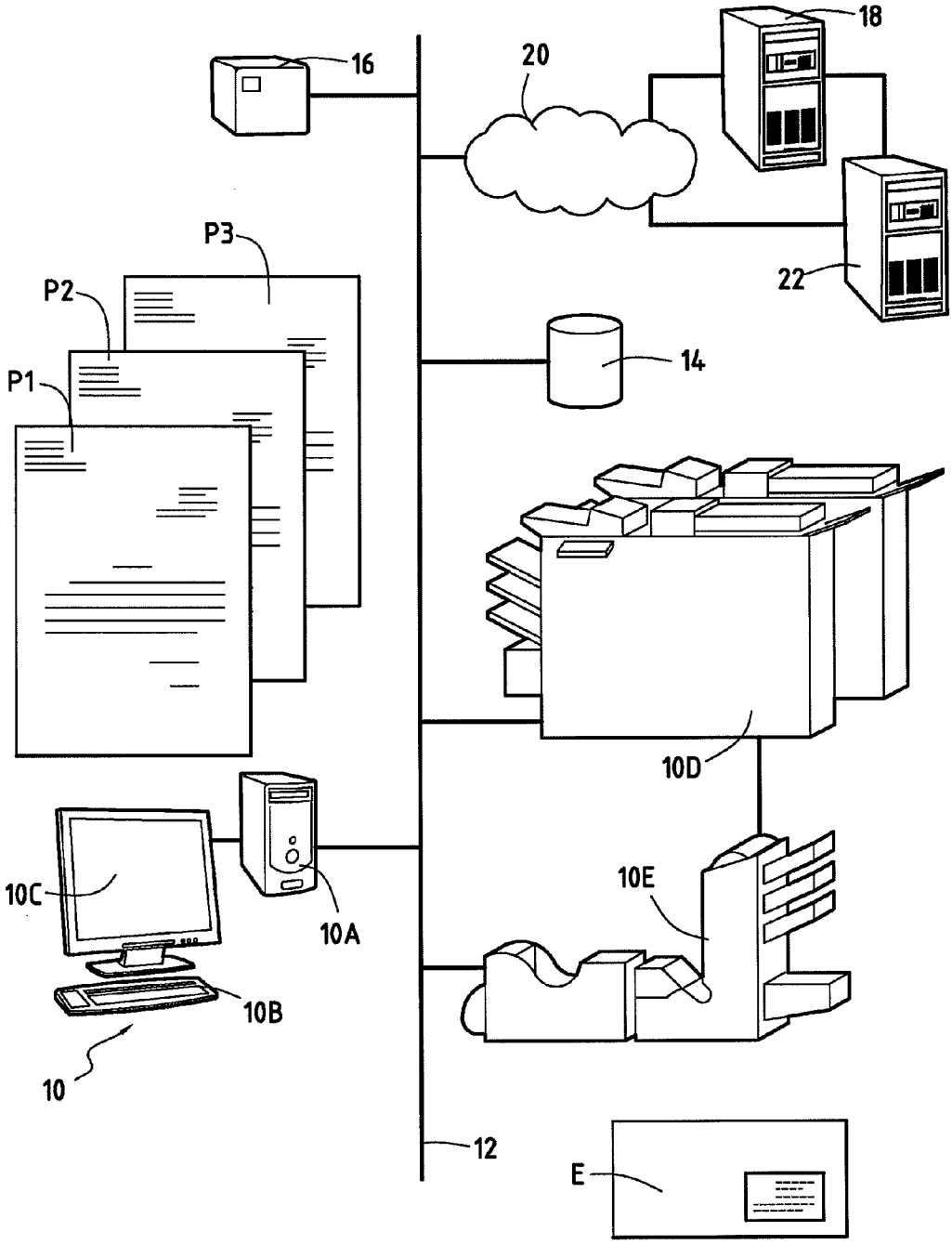
FIG. 1 shows an example of a mail production system of the invention.

FIG. 1 shows the architecture of a mail production system that makes it possible to prepare mailpieces, to put them into envelopes, and to frank them, and in which the invention can be implemented.

The system is organized around a conventional user workstation 10 that is preferably part of a local network 12 internal to the firm to which the user workstation belongs and that conventionally comprises at least one central processing unit 10A and a user interface (keyboard 10B and screen 10C). From this user workstation, in addition to having access to the standard office automation functions thereof, the user can also access a mail production application that is preferably available on a centralized computer server 14 for the purpose of retrieving the various pages (e.g. P1 to P3) making up a given document that the user wishes to send, whether said pages are to be found on the user's own workstation or on another user's workstation, or distributed between the two (it is thus possible to gather together pages coming from different software applications), or indeed in a database of the firm that is advantageously present on said centralized computer server. As is known, said application also has all of the functionality features necessary for franking a mailpiece and thus enables the user, by following the instructions displayed, to input all of the data necessary for sending a mailpiece, such as the country of destination, the insured value, and various items of data relating to added-value services, such as a tracking service, for example.

High-print-rate printer means 10D, e.g. a laser printer, are also provided that are connected to the local network 12 but that are advantageously disposed in the mail department of the firm, and folding and insertion means 10E, e.g. a folder/inserter, are also provided that are connected to the printer means and at which the pages of the document that are printed by the printer means are folded and inserted into an envelope E, that is advantageously an envelope having a window, and whose flap is stuck down once the insertion is complete. As in any franking system of the open type designed to use a standard printer to print a postal imprint containing a franking or postage amount having monetary value, it is necessary for the central processing unit 10A to be connected to a Postal Security Device (PSD) 16 that delivers proof of the payment of the franking for the postal service that is to handle the mail. The postal security device is itself connected to a computer server 18 of the dealer directly, or via a communications network 20. The server 18 is in turn connected to a computer server 22 of the postal authority. Naturally, the computer servers of the dealer of the postal security device and of the postal authority can themselves be accessible from the communications network as shown.

It is important to note that the above-mentioned franking stage that implements the postal security device 16 and the servers 18 and 22 connected to the communications network 20 is not essential to the invention and can be performed externally, e.g. by a dispatcher to whom the mailpieces are taken once they have been put into their envelopes by the folding and insertion means 10E.

Figure 2:
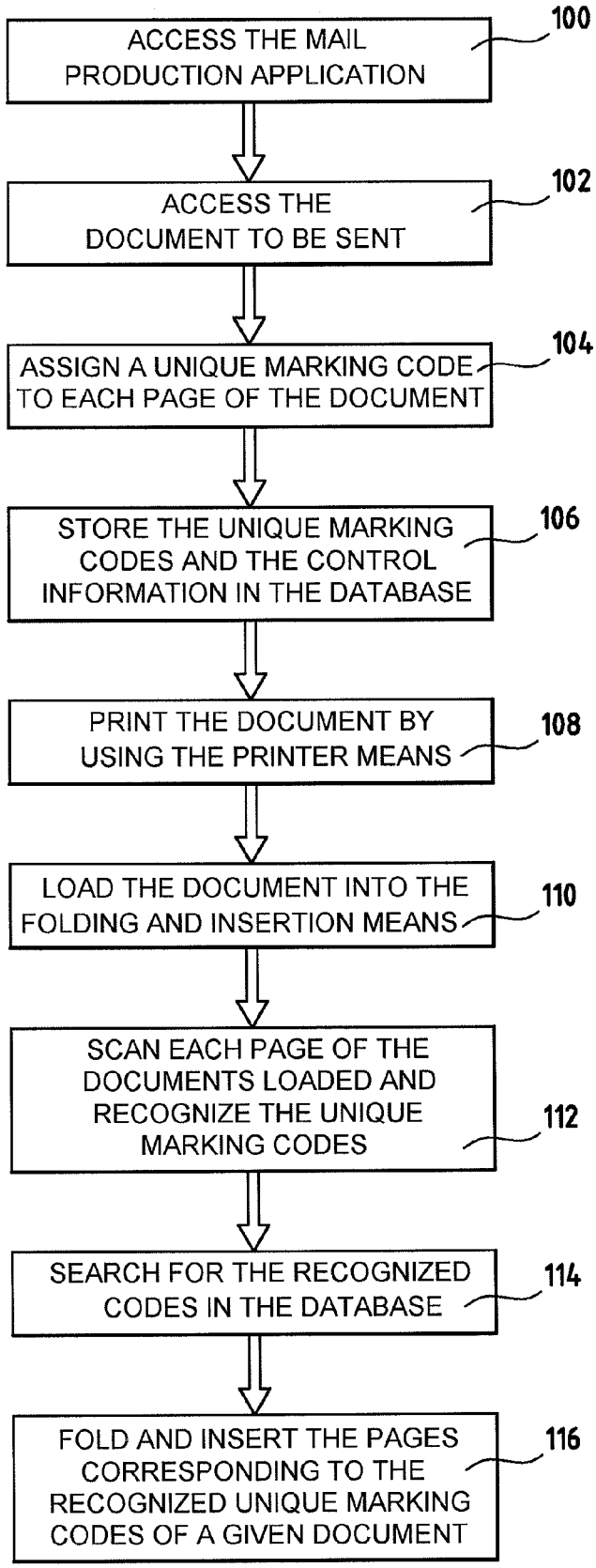
FIG. 2 is a flow chart showing the various steps for preparing mailpiece-forming documents and for putting them into an envelope.

FIG. 2 is a flow chart showing the various steps for preparing mailpiece-forming documents and for putting them into an envelope.

In a first step 100, a user who wishes to send a mailpiece accesses the mail production application from the workstation 10 that, in a step 102, asks the user which document said user wishes to send, so that said workstation can retrieve the various pages of said document. Once the pages have been retrieved, said workstation acts, in a step 104 and in accordance with the invention, to determine, for each page of the document, a unique marking code that it is to associate with information that is known per se and that is suitable for controlling the folding and insertion means, all of this data, control information, and unique marking codes of the document being, in a step 106, stored in the database of the centralized computer server 14. In another step 108, the documents are then printed by the printer means 10D and are then loaded into the folding and insertion means 10E in a following step 110. This loading step can be performed automatically if the folding and insertion means are connected directly to the printer means, or otherwise manually in batches or while the printing is taking place. In step 112, sending an insert-into-envelope instruction launches scanning of each of the pages of the documents loaded into the folding and insertion means 10E and automatic extraction of the unique marking codes contained in the pages by the Optical Character Recognition (OCR) means. In a following step 114, a search for codes that are identical or statistically similar in the database then, makes it possible, in a terminal step 116, to fold and insert the recognized pages of the preciously printed document into the envelope that is to receive it, before sticking down the flap of said envelope. The envelope closed in this way is then handed over to a dispatcher that is entrusted with the task of franking it. When one of the pages of a document is not validly recognized, an error code is generated and preferably all of the pages of the document are directed to a bin for subsequent manual handling.

Figure 3:
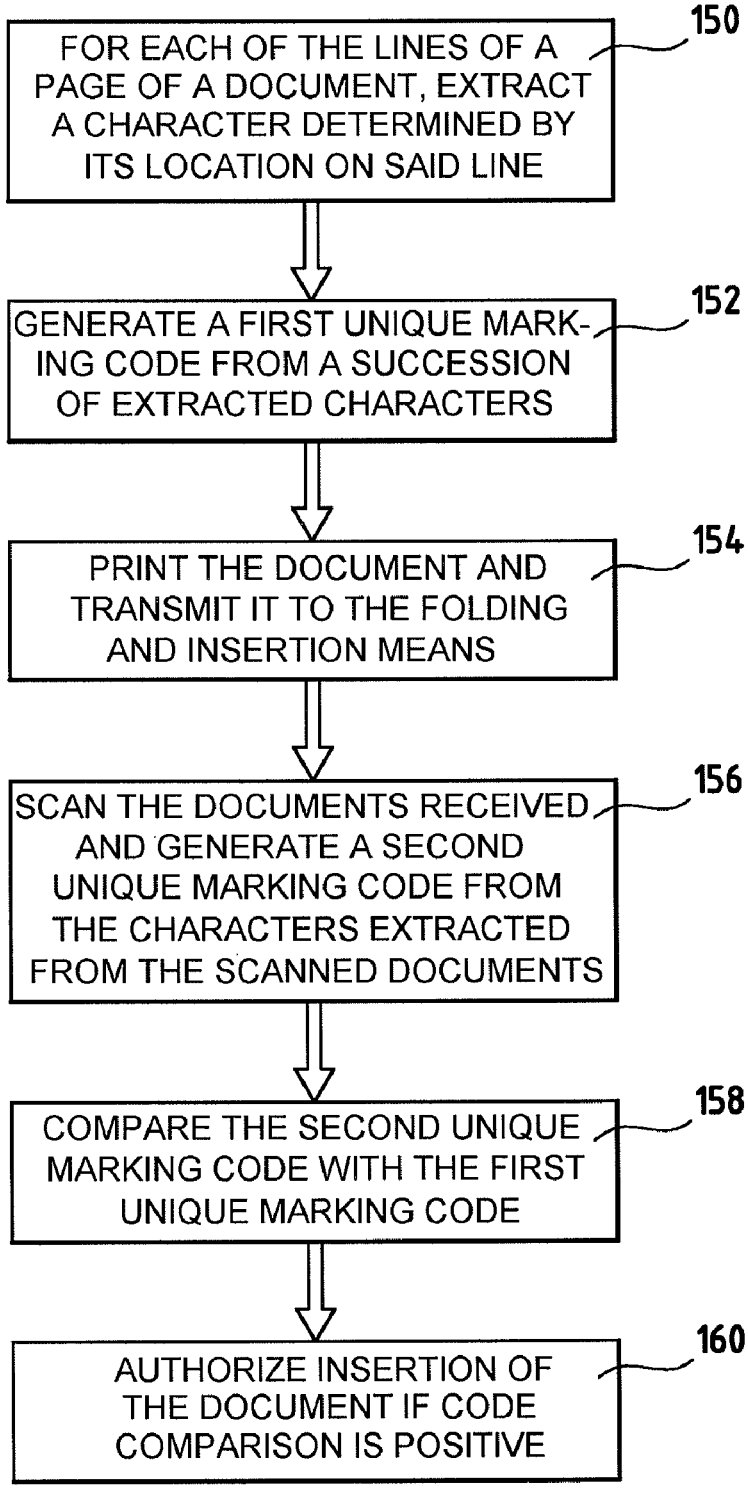
FIG. 3 is a flow chart showing the various steps for generating a unique marking code making it possible to put a mailpiece into an envelope.

FIG. 3 shows more precisely how the method of the invention makes it possible, without using OMR, to assign a unique marking code to each page of a printed document in order to enable it to be put subsequently into an envelope.

In accordance with the invention, since the printer means are capable of determining the characters printed on each page, it is therefore possible for said printer means to extract (step 150), from each of the lines of each page or of each of certain pages only, a predetermined character defined by its location in said line, e.g. the $n^{th}$ character of the line, and, on the basis of all of these same $n^{th}$ characters of the page, to generate (step 152) the unique marking code that is specific to said page. The resulting alphanumeric word obtained by the string of said characters that can be digits, letters, special characters, or even spaces, is a kind of signature for the page. Once the codes of all of the pages of a document have been determined, said document can be printed before being transmitted to the folding and insertion means (step 154). When the insertion stage starts, the folding and insertion means that are provided with the scanning and OCR means can reconstruct the unique marking code associated with each page by extracting therefrom the characters that it contains (step 156), naturally chosen using the same process as the process that served to create the original code. It then suffices for said means to use a search to compare (step 158) said code with the codes present in the database created during the printing stage in order to allow the page to be inserted into the envelope that is to receive it (step 160).

It should be noted that, due to dust being present, or, for example, to scanning being performed on a skew, it is possible for the resulting marking code to be somewhat different from the original code. That is why the OCR means also have statistical computation means for determining which original code is the most likely and thus the closest to the scanned code, such means being known per se, e.g. of the type using the Mahalanobis distance, the Euclidean distance, or the Manhattan distance.

Naturally, although the invention is described with reference to the string of the $n^{th}$ characters of each line being taken into account as a unique code, the invention is in no way limited to this configuration, and any other configuration can also be envisaged, such as taking the $n^{th}$ and the $k^{th}$ characters of each line or indeed taking, for example, the first character of the first line, the second character of the second line, the third character of the third line and so on. More precisely, any predetermined combination of characters making it possible to obtain a unique marking code can be envisaged.

With the present invention, it is thus possible to produce commercial letters having exceptional print quality that are not marred by the unpleasant presence of printed marks. In addition, since the quantity of ink ejected is smaller, the printing cycle for any given print head is extended.

What is claimed is:

1. A method of inserting the pages of a document into an envelope in a mail production system comprising at least one user workstation on which said document is generated, printer means for printing the pages of said document, and folding and insertion means for folding the pages once they have been printed and for inserting them into an envelope, the method comprising the following steps:

in order to control insertion into said envelope of each of said pages of the document, said folding and insertion means generating, for each page of said document and without printing, a unique marking code on the basis of a predetermined combination of characters extracted from each of said pages; and comparing said unique marking codes with marking codes that are generated while said documents are being generated and on the basis of said predetermined combination of characters, said marking codes being stored in a database accessible from said folding and insertion means.

2. A method according to claim 1, wherein said predetermined combination of characters is an alphanumeric word formed by a string of the $n^{th}$ characters of respective lines of said page, where n is predetermined, not less than one and less than or equal to the number of characters per line of said page.

3. A method according to claim 1, wherein said predetermined combination of characters is an alphanumeric word formed by a string of the $n^{th}$ and $k^{th}$ characters of each of the respective lines of said page, where n and k are predetermined and each of them is less than or equal to the number of characters per line of said page, n being not less than 1 and k being not less than 2.

4. A method according to claim 1, wherein said predetermined combination of characters is an alphanumeric word formed by a string comprising the first character of the first line, the second character of the second line, the third character of the third line, continuing to the last line of said page.

5. A method according to claim 1, wherein said unique marking code is generated at a computer server and is then sent to said folding and insertion means with control information for controlling said folding and insertion means.

* * * * *